US011735827B2

(12) United States Patent
Li et al.

(10) Patent No.: US 11,735,827 B2
(45) Date of Patent: Aug. 22, 2023

(54) SLOTTED SUBSTRATE INTEGRATED AIR WAVEGUIDE ANTENNA ARRAY

(71) Applicant: The Board of Trustees of the University of Alabama, Tuscaloosa, AL (US)

(72) Inventors: Linfeng Li, Tuscaloosa, AL (US); Stephen Yan, Northport, AL (US)

(73) Assignee: The Board of Trustees of the University of Alabama, Tuscaloosa, AL (US)

( * ) Notice: Subject to any disclaimer, the term of this patent is extended or adjusted under 35 U.S.C. 154(b) by 82 days.

(21) Appl. No.: 17/092,836

(22) Filed: Nov. 9, 2020

(65) Prior Publication Data

US 2021/0210865 A1 Jul. 8, 2021

Related U.S. Application Data

(60) Provisional application No. 62/957,983, filed on Jan. 7, 2020.

(51) Int. Cl.
*H01Q 1/38* (2006.01)
*H01Q 13/26* (2006.01)
(Continued)

(52) U.S. Cl.
CPC ..... *H01Q 21/005* (2013.01); *H01Q 1/38* (2013.01); *H01Q 13/26* (2013.01); *H01Q 21/0043* (2013.01); *H01P 5/107* (2013.01)

(58) Field of Classification Search
CPC ..... H01Q 21/005; H01Q 1/38; H01Q 13/26; H01Q 21/0043; H01P 5/107; H01P 3/121
See application file for complete search history.

(56) References Cited

U.S. PATENT DOCUMENTS 7,142,165 B2 11/2006 Sanchez et al.
7,411,472 B1 8/2008 West et al.
10,103,448 B1 * 10/2018 Izadian ..... H01Q 21/005

FOREIGN PATENT DOCUMENTS

CN 106384876 A * 2/2017
CN 109346851 2/2019
CN 110323574 A * 10/2019 ..... H01Q 13/06

OTHER PUBLICATIONS

Tian et al., "Investigation of SU8 as a structural material for fabricating passive millimeter-wave and terahertz components," Journal of Micro/Nanolithography, MEMS and MOEMS, Issue: 4, vol. 14, p. 44507-44507 (Dec. 29, 2015) (Year: 2015).*
(Continued)

*Primary Examiner* — Ab Salam Alkassim, Jr.
*Assistant Examiner* — Anh N Ho
(74) *Attorney, Agent, or Firm* — Meunier Carlin & Curfman LLC

(57) ABSTRACT

A slotted Substrate Integrated Air Waveguide (slotted SIAW) antenna array comprising a ground plane having a reflective planar surface formed of a conductive material; an air waveguide structure fixably attached to, or formed onto, the reflective surface of the ground plane and having a slotted aperture defined, in part, by two conductive side walls that terminates at a conductive end wall, where a portion of the conductive side walls and a portion of the conductive end wall define an aperture-facing radiative conductive surface of the aperture and electrically couples with a conductive antenna feedline; and a slotted cover plate fixably attached to, or formed onto, the slotted-waveguide structure and having an area that fully covers the slotted aperture and has two or more radiating slotted apertures coincident to the slotted aperture and to the reflective planar surface of the ground plane.

14 Claims, 15 Drawing Sheets

Air waveguide
(Before milling
and cutting)

(51) Int. Cl.
*H01Q 21/00* (2006.01)
*H01P 5/107* (2006.01)

(56) References Cited

OTHER PUBLICATIONS

Mittal, A. (Oct. 5, 2015). "PCB substrates: Knowing your PCB dielectric materials. Sierra Circuits". Retrieved Mar. 24, 2022, from https://www.protoexpress.com/blog/pcb-substrates-knowing-dielectric-materials-properties/ (Year: 2015).*

Radar Frequency Bands. Capture taken Oct. 18, 2018. Wayback Machine. Retrieved Mar. 24, 2022, from https://web.archive.org/web/20181018025737/http://www.aewa.org/Library/rf_bands.html (Year: 2018).*

Liu et al, "A Millimeter-Wave Micromachined Air-Filled Slot Antenna Fed by Patch," in IEEE Transactions on Components, Packaging and Manufacturing Technology, vol. 7, No. 10, pp. 1683-1690, Oct. 2017, doi: 10.1109/TCPMT.2017.2711361 (Year: 2017).*

"Conductivity of Brass". Capture taken Jun. 13, 2016. Wayback Machine. Retrieved Mar. 24, 2022, from https://web.archive.org/web/20160613190626/https://www.copper.org/applications/industrial/DesignGuide/selection/conductbrass02.html) (Year: 2016).*

"Conductive materials, metals and stainless steels properties table". Capture take Aug. 31, 2019. Wayback Machine. Retrieved Mar. 28, 2022 from https://web.archive.org/web/20190831011431/https://www.tibtech.com/conductivite.php?lang=en_US (Year: 2019).*

Parment et al, "Millimetre-wave air-filled substrate integrated waveguide slot array antenna", May 2017, Electronics Letters, vol. 53, No. 11, pp. 704-706 (Year: 2017).*

Khan et al, "Empty Substrate Integrated Waveguide Slot Antenna Array for 5G Applications", 2018, IEEE MTT-S International Microwave Workshop Series on 5G Hardware and System Technologies (IMWS-5G), pp. 1-3 (Year: 2018).*

Qi et al, "Low-Cost Empty Substrate Integrated Waveguide Slot Arrays for Millimeter-Wave Applications", 2019, IEEE Antennas and Wireless Propagation Letters, vol. 18, No. 5, pp. 1021-1025 (Year: 2019).*

Henry, Manju, et al. "Millimeter wave substrate integrated waveguide antennas: Design and fabrication analysis." IEEE Transactions on Advanced Packaging 32.1 (2009): 93-100.

McGrath, William R., et al. "Silicon micromachined waveguides for millimeter-wave and submillimeter-wave frequencies." IEEE Microwave and Guided Wave Letters 3.3 (1993): 61-63.

Henry, Manju, et al. "Integrated air-filled waveguide antennas in LTCC for G-band operation." 2008 Asia-Pacific Microwave Conference. IEEE, 2008, 4 pages.

She, Yuanfeng, et al. "LTCC oversized rectangular waveguide slot array antenna with air-layer in the radiating part in the millimeter-wave band." IEEE transactions on antennas and propagation 61.4 (2012): 1777-1783.

Parment, Frédéric, et al. "Millimetre-wave air-filled substrate integrated waveguide slot array antenna." Electronics Letters 53.11 (2017): 704-706.

Chen, Xiao-Ping, et al. "Low-cost high gain planar antenna array for 60-GHz band applications." IEEE Transactions on Antennas and Propagation 58.6 (2010): 2126-2129.

* cited by examiner

SLOTTED SUBSTRATE INTEGRATED AIR WAVEGUIDE ANTENNA ARRAY

RELATED APPLICATION

This application claims priority to, and the benefit of, U.S. Provisional Patent Application No. 62/957,983, filed Jan. 7, 2020, entitled "SLOTTED SUBSTRATE INTEGRATED WAVEGUIDE ANTENNA ARRAY," which is incorporated by reference herein in its entirety.

GOVERNMENT LICENSED RIGHTS

This invention was made with government support under Grant No. 26548 awarded by the National Oceanic and Atmospheric Administration (NOAA). The government has certain rights in the invention.

BACKGROUND

Conventional slotted Substrate Integrated Waveguide (slotted SIW) antenna array is well-known for its simplicity and high integration capability with communication circuits. SIW generally comprises a dielectric filled rectangular waveguide formed within a double-sided printed circuit board (PCB), and the structure is caged with rows of plated tightly spaced vias that run through the guide. The vias are coated with a conductive material. The slotted antenna array structure is directly milled on top of the SIW.

The vias of SIW are particularly difficult to manufacture for high frequency operation, especially at the millimeter wave (mm-Wave) spectrum. Wave leakage through the vias is generally more noticeable at higher frequency operation. Also, the dielectric material within the SIW often exhibits substantial dielectric loss at the high frequency range. Thus, the high-performance operation of slotted SIW antenna array often relies on high-cost fabrication and very expensive dielectric materials.

There is a benefit to have improved slotted SIW antenna array design.

SUMMARY

The exemplified systems and methods provide a slotted Substrate Integrated Air Waveguide (slotted SIAW) antenna array having a design that can be more readily fabricated as compared to a slotted SIW antenna array of comparable performance. In addition, the exemplified systems are configured for millimeter wave application without use of exotic low dielectric loss material.

In an aspect, an antenna array disclosed comprising a ground plane having a reflective planar surface formed of a conductive material; an air waveguide structure fixably attached to, or formed onto, the reflective surface of the ground plane, the air waveguide structure defined by a waveguide width W and waveguide length L, the air waveguide structure having a slotted aperture (e.g., a centrally located aperture) defined, in part, by two conductive side walls that terminates at a conductive end wall, wherein a portion of the conductive side walls and a portion of the conductive end wall collectively define an aperture-facing radiative conductive surface (e.g., copper plated edges) of the slotted aperture, and wherein the aperture-facing radiative conductive surface of the slotted aperture electrically couples with a conductive antenna feedline of the antenna array; and a slotted cover plate fixably attached to, or formed onto, the slotted-waveguide structure, wherein the slotted cover plate has an area that fully covers the slotted aperture, wherein the slotted cover plate has two or more radiating slotted apertures coincident to the slotted aperture of the slotted-waveguide structure and to the reflective planar surface of the ground plane.

In some embodiments, the slotted cover plate comprises a first material selected from the group consisting of copper, aluminum, zinc, nickel, silver, gold, and a combination thereof, and having a first electrical conductivity property, and wherein the conductive side walls and end wall of the air waveguide structure can be plated with a second material selected from the group consisting of copper, aluminum, zinc, nickel, silver, gold, and a combination thereof, and having a second electrical conductivity property, wherein the second electrical conductivity property is higher than the first electrical conductivity property.

In some embodiments, the two conductive side walls and the conductive end wall form a continuous surface.

In some embodiments, the slotted aperture is generally rectangular.

In some embodiments, the slotted cover plate has a number of radiating slotted apertures selected from the group consisting of 2 slots, 3 slots, 4 slots, 5, slots, 6, slots, 7 slots, and 8 slots.

In some embodiments, the slotted aperture has four side walls, and wherein the two conductive side walls and the conductive end wall wholly spans three of the four side walls.

In some embodiments, the antenna array has an antenna efficiency greater than 90 percent.

In some embodiments, the air waveguide structure comprises a substrate that is cut to form the slotted aperture.

In some embodiments, the aperture-facing radiative conductive surface comprises a material or alloy selected from the group consisting of copper, aluminum, nickel, iron, and a combination thereof.

In some embodiments, the aperture-facing radiative conductive surface comprises a material or alloy selected from the group consisting of copper, aluminum, nickel, iron, zinc, and a combination thereof.

In some embodiments, the slotted cover plate comprises a copper zinc alloy (e.g., brass).

In some embodiments, a substrate of the slotted-waveguide structure comprises a dielectric material (e.g., Rogers R04350B or Rogers R05880).

In some embodiments, the slotted-waveguide structure is configured for an operating frequency having a center frequency around 28 GHz or more.

In another aspect, a method is disclosed of fabricating an antenna array, the method comprising providing a ground plane having a reflective planar surface formed of a conductive material; attaching a slotted-waveguide structure to the ground plane, the air-waveguide structure defined by a waveguide width W and waveguide length L, the air-waveguide structure having a slotted aperture (e.g., a centrally located aperture) defined, in part, by two conductive side walls that terminates at a conductive end wall, wherein a portion of the conductive side walls and a portion of the conductive end wall collectively define an aperture-facing radiative conductive surface (e.g., copper plated edges) of the slotted aperture, and wherein the aperture-facing radiative conductive surface of the slotted aperture electrically couples with a conductive antenna feedline of the antenna array; and attaching a slotted cover plate to the air-waveguide structure, wherein the slotted cover plate has an area that fully covers the slotted aperture, wherein the slotted cover plate has two or more radiating slotted apertures coincident to the slotted aperture of the air-waveguide structure.

In some embodiments, the step of attaching the air-waveguide structure comprises cutting (e.g., via laser cutting) the slotted aperture in a stock material comprising a plate to form a waveguide substrate of the air-waveguide structure; plating the cut stock material to form the two conductive side walls and two conductive end walls; and milling the plated waveguide substrate at one of the two conductive end walls to provide the slotted aperture with only the two conductive side walls that terminates at the conductive end wall.

In some embodiments, the step of attaching the slotted cover plate onto the air-waveguide structure comprises cutting the two or more radiating slotted apertures in a second stock material comprising a plate to form the slotted cover plate; and attaching the slotted cover plate to the air-waveguide structure.

In some embodiments, the slotted cover plate is attached to the air-waveguide structure by a plurality of fasteners, chemical bonding (e.g., conductive adhesives), thermal bonding, laser bonding, welding, soldering, or a combination thereof.

In some embodiments, the slotted cover plate is attached to the air-waveguide structure by aligning and connecting the slotted cover plate to the air-waveguide structure using the plurality of fasteners; and soldering conduction portion of the slotted cover plate to conduction portion of the air-waveguide structure.

In another a system is disclosed comprising a ground plane having a reflective planar surface formed of a conductive material; an air-waveguide structure fixably attached to, or formed onto, the reflective surface of the ground plane, the air-waveguide structure defined by a waveguide width W and waveguide length L, the air-waveguide structure having an air slotted aperture (e.g., a centrally located aperture) defined, in part, by two conductive side walls that terminates at a conductive end wall, wherein a portion of the conductive side walls and a portion of the conductive end wall collectively define an aperture-facing radiative conductive surface (e.g., copper plated edges) of the air slotted aperture, and wherein the aperture-facing radiative conductive surface of the air slotted aperture electrically couples with a conductive antenna feedline of the antenna array; and a slotted cover plate fixably attached to, or formed onto, the air-waveguide structure, wherein the slotted cover plate has an area that fully covers the air slotted aperture, wherein the slotted cover plate has two or more radiating slotted apertures coincident to the slotted aperture of the air-waveguide structure and to the reflective planar surface of the ground plane.

In some embodiments, the system further includes an integrated circuit electrically coupled to the air-waveguide structure.

BRIEF DESCRIPTION OF THE DRAWINGS

The components in the drawings are not necessarily to scale relative to each other and like reference numerals designate corresponding parts throughout the several views.

DETAILED SPECIFICATION

Each and every feature described herein, and each and every combination of two or more of such features, is included within the scope of the present invention provided that the features included in such a combination are not mutually inconsistent.

Figure 1:
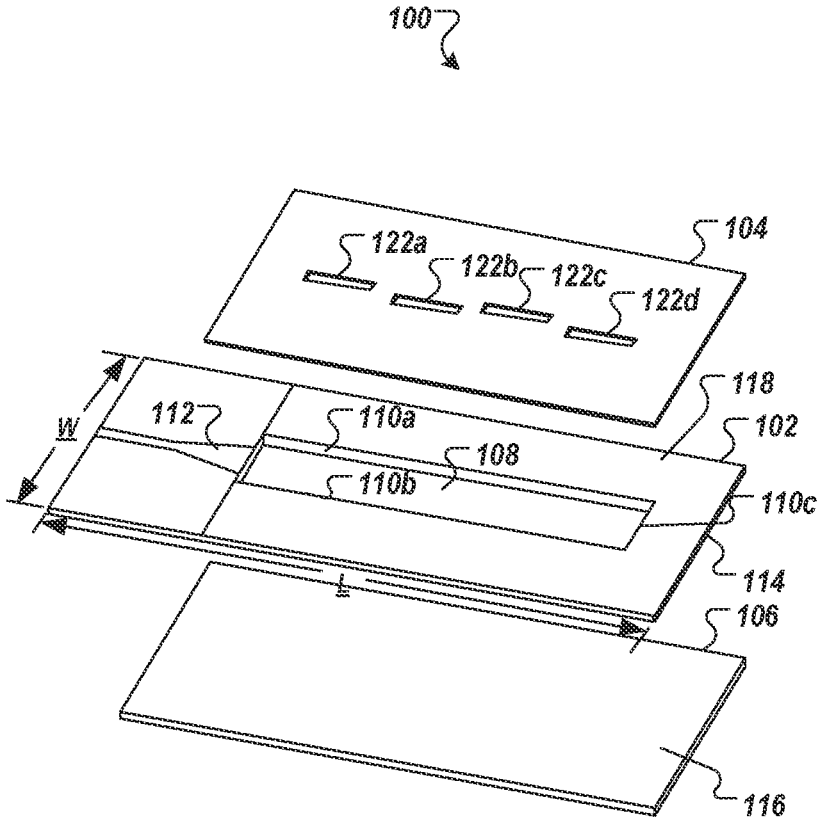
FIG. 1 shows a diagram of an exemplary slotted Substrate Integrated Air Waveguide (slotted SIAW) antenna array in accordance with an illustrative embodiment.

FIG. 1 shows a diagram of an exemplary slotted substrate-integrated-air waveguide (slotted SIAW) antenna array 100 in accordance with an illustrative embodiment. The slotted substrate-integrated-air waveguide (SIAW) antenna array 100 includes an air-waveguide structure 102 (also referred to herein as a slotted waveguide structure 102), a slotted-array cover plate 104 (also referred to herein as a slotted cover plate 104), and a ground plane 106.

The slotted-waveguide structure 102 has a slotted aperture 108 (e.g., a centrally located aperture) that is defined, in part, by two conductive side walls 110 (shown as 110*a* and 110*b*) that terminates at a conductive end wall (shown as 110*c*). A portion, or all surfaces, of the conductive side walls 110*a*, 110*b*, and 110*c* collectively defines an aperture-facing radiative conductive surface (e.g., conductive material plated edges) of the slotted aperture 108. In FIG. 1, the slotted aperture has four side walls in which the three conductive side walls extend away from the feedline 112 of the antenna array 100. The three-sided wall may form a continuous conductive surface. In other embodiments, the three-sided may have discontinuous or pattern in the conductive surface. The slotted-waveguide structure 102, in the slotted aperture 108, may be an air- or a dielectric-filled waveguide and is defined by a waveguide width W and waveguide length L. The slotted aperture 108, in some embodiments, is generally rectangular in shape. In other embodiments, slotted aperture 108 may form other polygonal shapes. The slotted-waveguide structure 102, particularly, at least the conductive side walls 110*a*, 110*b*, and 110*c*, are made of a conductive material including, for example, but not limited to copper, aluminum, nickel, iron, or a combination thereof. The slotted-waveguide structure 102 may additionally include dielectric material, e.g., as a substrate, to form a composite structure.

Referring to FIG. 1, the slotted-waveguide structure 102 is fixably attached to, or formed onto, at its backside 114, the ground plane 106. The ground plane 106 is formed partially or completely made of a conductive material and has a conductive reflective surface 116 that faces the slotted-waveguide structure 102. In some embodiments, the ground plane 106 includes one more intermediate layers that are situated between the conductive reflective surface 116 and the air waveguide structure 102 (e.g., Pre-reg 1080 layer). The ground plane 106 may be made of a conductive material such as copper or copper alloy, or the like (e.g., having nickel, aluminum, zinc, nickel, etc.). The ground plane 106 has an area that fully covers the slotted aperture 108. In some embodiments, the ground plane 106 has an area that spans the radiating portion 118 of the slotted-waveguide structure 102. In some embodiments, the ground plane 106 has an area that spans the entire substrate (e.g., defined by length L and width W) of the slotted-waveguide structure 102. In some embodiments, the slotted-waveguide structure 102 is fixably attached to the ground plane 106 via fasteners. In other embodiments, chemical bonding (e.g., conductive adhesives), thermal bonding, laser bonding, welding, soldering, or a combination thereof may be used.

Referring to FIG. 1, the slotted-waveguide structure 102 is fixably attached, or formed onto, at its front side 118, the slotted cover plate 104. The slotted cover plate 104, in some embodiments, has an area that fully covers the slotted aperture 104. The slotted cover plate 104 has two or more radiating slotted apertures 122 (shown as 122*a*, 122*b*, 122*c*, and 122*d*) that coincides, or is coincident to, the slotted aperture 108. The slotted cover plate 104 is formed partially or completely made of a conductive material that has lower conductivity than that of the slotted-waveguide structure 102. To this end, the slotted cover plate 104 may have an area spans the radiating portion 118 of the slotted-waveguide structure 102. In some embodiments, the slotted cover plate 104 has an area that spans the entire substrate (e.g., defined by length L and width W) of the slotted-waveguide structure 102, or a substantial portion thereof.

In some embodiments, the slotted-waveguide structure 102 is fixably attached to the slotted cover plate 104 via fasteners. In other embodiments, chemical bonding (e.g., conductive adhesives), thermal bonding, laser bonding, welding, soldering, or a combination thereof may be used.

In some embodiments, the slotted cover plate 104 is made of a low conductivity copper-based alloy, such as a brass (e.g., alloy of copper and zinc). Other materials may be used such as tin, lead, iron, nickel, aluminum, or a combination thereof.

Although shown with 4 slots (122*a*-122*d*), the slotted cover plate 104 may have other numbers of radiating slotted apertures 122 including, for example, but not limited to, 2 slots, 3 slots, 4 slots, 5, slots, 6, slots, 7 slots, and 8 slots. In some embodiments, the slotted cover plate 104 has greater than 8 slots.

The slotted-waveguide structure 102, and corresponding antenna 100, may be configured for an operating frequency having a center frequency around 28 GHz. The antenna 100 may be suitably use for millimeter wave application or spectrum (also referred to herein as "mmWave"). In some embodiments, the operating frequency may have a center frequency greater than 28 GHz The exemplary slotted SIAW antenna array 100 may be considered to include two main components, namely, the waveguide portion (e.g., 102, 102*a*) and the slot antenna array design (e.g., 104, 104*a*).

The waveguide portion (e.g., 102, 102*a*) may share similar principle of operation and design as traditional metallic waveguide. With proper selection of the width and height of the waveguide, electromagnetic wave above a certain frequency can propagate through the waveguide. The frequency is often called the "TE10" mode cut-off frequency ($f_c$). The equation of calculating $f_c$ is provided in Equation 1.

$$f_c = \frac{c}{2a \times \sqrt{\varepsilon_r}} \quad \text{(Equation 1)}$$

Figure 7:
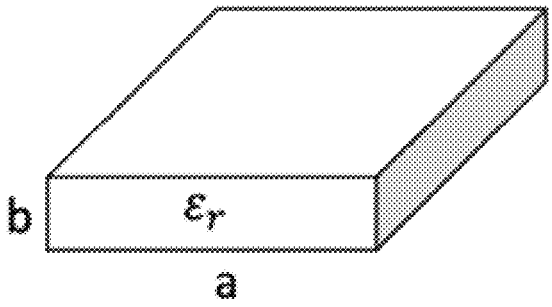
FIG. 7 shows a model of a waveguide.

In Equation 1, C is the speed of light in free space, a is the width of the waveguide, and $\varepsilon_r$ is the dielectric constant of the material in the slot of the waveguide, as shown in FIG. 7.

Figure 8A:
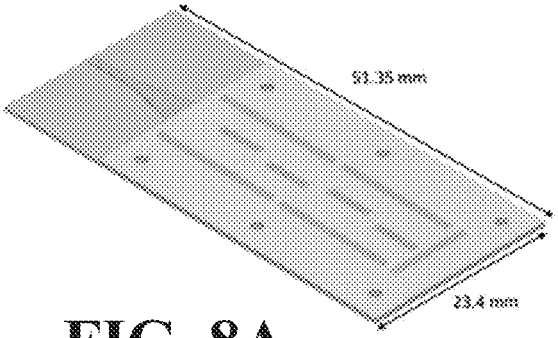
FIGS. 8A, 8B, 8C, and 8D show example dimensions of an exemplary slotted substrate-integrated-air waveguide (slotted SIAW) antenna array of FIG. 2 in accordance with another illustrative embodiment.
Figure 8B:
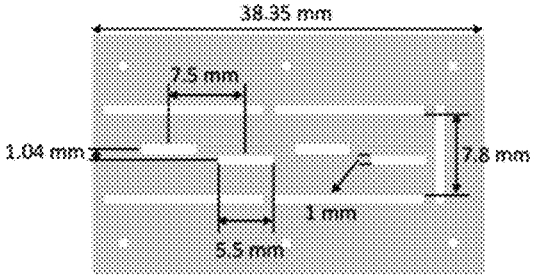
Figure 8C:
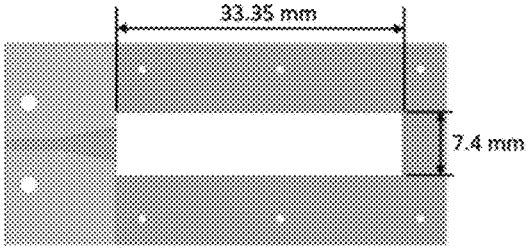
Figure 8D:
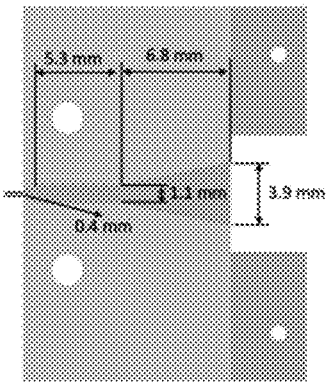

The thickness of the waveguide b may not affect the cut-off frequency but may affect the impedance of the waveguide. To design the waveguide for the slotted antenna array, $f_c$ should at least be smaller than the lowest frequency supported by the antenna. In an exemplary 28-GHz slotted SIAW antenna array embodiment, the operating frequency may be set between 26.8 GHz and 29.6 GHz. For this embodiment, the width of air waveguide may be configured to be around 7.4 mm to provide a cut-off frequency of around 20 GHz. The length of the waveguide may be around 33.35 mm, which may be determined by the total number of slot antenna elements. Example dimensions of the waveguide and corresponding antenna structure for this frequency operation is provided in FIGS. 8A, 8B, and 8C. FIG. 8D shows example dimensions for feedline 112 comprising a microstrip line to air waveguide transition.

To provide the desired gain and bandwidth, in some embodiments, the thickness of the slotted cover plate 104 (e.g., brass cover plate) is selected based on radiating efficiency and mechanical stability. In some embodiments, the plate may have the thinnest thickness (to provide higher efficiency) while still providing sufficient mechanical stability for the application of interest. In some embodiments, the length of the antenna (e.g., plate cover 104, 104*a* and the corresponding waveguide 102, 102*a*) are selected to be about a quarter wavelength at the center frequency.

In some embodiments, the distance between the center of two adjacent slots (e.g., 122) is less than one wavelength at the highest frequency (e.g., to avoid or minimize grating lobes). An example set of dimensions of the slotted cover plate 104 (e.g., slotted brass cover plate) are provided in FIG. 8B. In some embodiments, to match the impedance, the center of slots should always have an offset from the center of waveguide. The offset is chosen to be 0.52 mm in the design. To optimize the bandwidth, the width of the slots (e.g., 122) may be adjusted. More slot antenna element may also be added based on the gain and beam width requirement.

Figure 2:
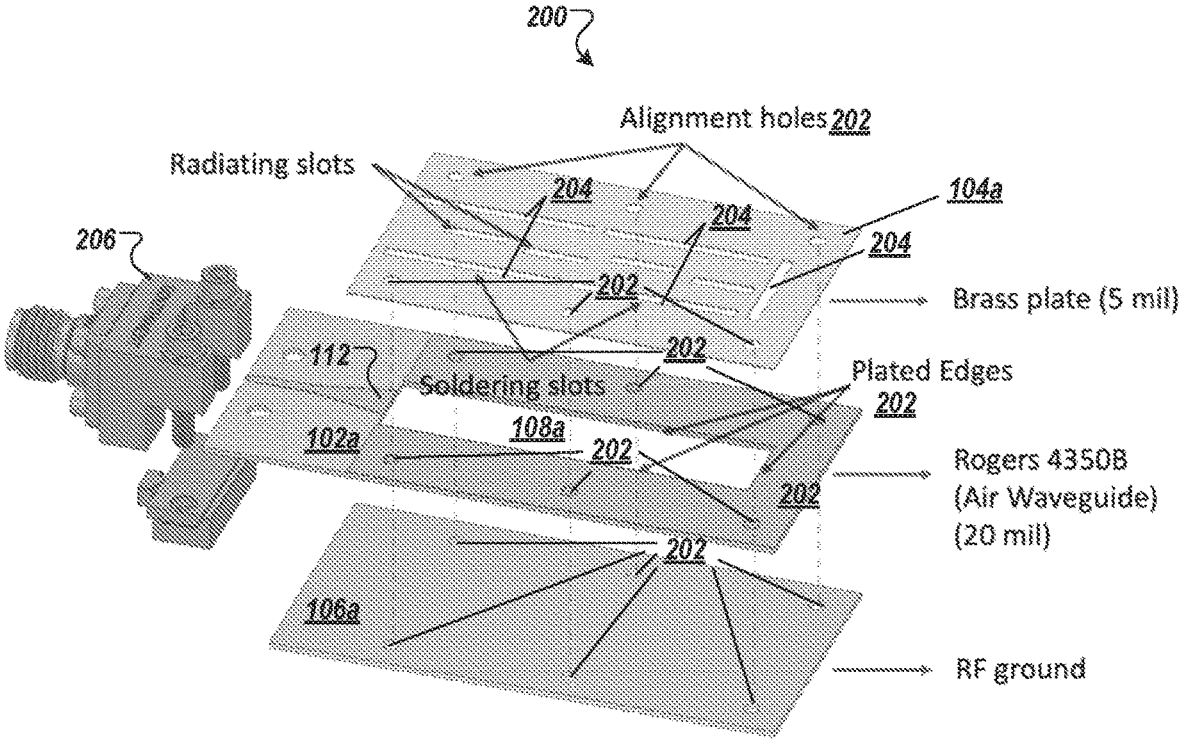
FIG. 2 shows another exemplary slotted Substrate Integrated Air Waveguide (slotted SIAW) antenna array in accordance with an illustrative embodiment.

FIG. 2 shows the exemplary slotted substrate-integrated-air waveguide (slotted SIAW) antenna array 100 of FIG. 1 configured as a slotted substrate-integrated-air waveguide (slotted SIAW) antenna array 200 in accordance with an illustrative embodiment. Notably, the slotted aperture 108 (shown as 108*a*) of the slotted-waveguide structure 102 (shown as 102*a*) is hollow to form an open space (i.e., air-filled).

Further, in FIG. 2, the slotted-waveguide structure 102*a*, the slotted cover plate 104 (shown as 104*a*), and the ground plane 106 (shown as 106*a*) of the slotted substrate-integrated-air waveguide (slotted SIAW) antenna array 200 are configured to assembled via fasteners. In FIG. 2, the structures 102*a*, 104*a*, 106*a* includes a set of alignment holes 202. The alignment holes may also be used during the fabrication of the antenna 200) to align the various apertures or components of the antenna array 200 in addition to fastening the structures 102*a*, 104*a*, and 106*a* together (fasteners are not shown). Example of fasteners includes threaded or non-treaded fasteners (e.g., bolts, screws, set-screws, nails, anchors, studs).

Further, in FIG. 2, the slotted cover plate 104*a* includes a set of soldering slots 204. The soldering slots 204 provides a space for further coupling between the slotted-waveguide structure (e.g., 102, 102*a*) and the slotted cover plate (e.g., 104, 104*a*).

Further, in FIG. 2, the slotted-waveguide structure 102*a* is shown to include a set of mounting holes to connect to a connector 206 that electrically couples to the feedline 112.

The exemplary slotted substrate-integrated-air waveguide antenna array 100 of FIG. 1 and the slotted substrate-integrated-air waveguide antenna array 200 of FIG. 2 improve on slotted substrate integrated waveguide (SIW) antenna array at mmWave operation, which is understood to have substantial losses caused by both wave leakage through gaps between copper plated through holes and lossy dielectric materials. Also, low loss dielectric materials associated with substrate integrated waveguide (SIW) antenna array are usually expensive. The exemplary slotted SIAW 100 or slotted SIAW 200 combines the advantages of the SIW and air-filled metallic waveguide by removing the dielectric materials within the SIW, replacing through holes with plated edges (e.g., copper plated edges) and covering the waveguide with slotted plate (e.g., slotted brass plate). Indeed, the mmWave slotted SIW antenna array or mmWave slotted SIAW antenna array is more economical to manufacture while having high performance (e.g., low dielectric loss, no wave leakage, high power handling features, etc.).

Figure 3:
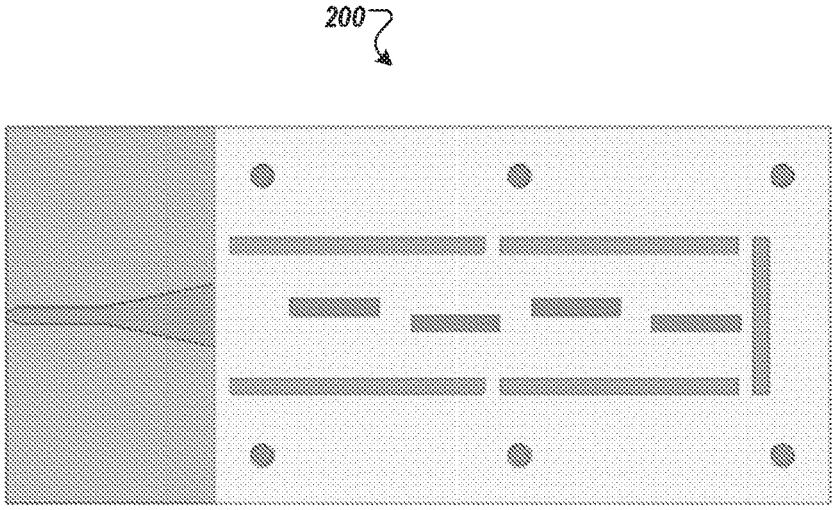
FIG. 3 shows a front/top view of the slotted substrate-integrated-air waveguide antenna array of FIG. 2 (when fully assembly) in accordance with an illustrative embodiment.
Figure 4A:
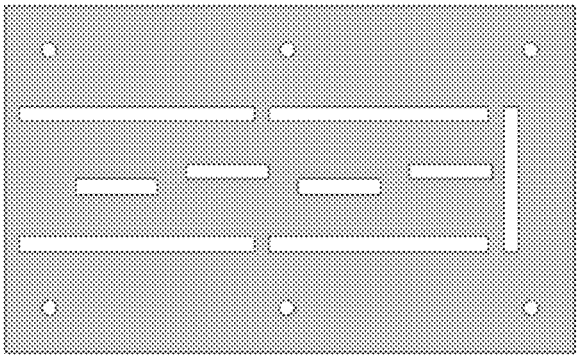
FIGS. 4A, 4B, and 4C, respectively, show the front/top view of the air-waveguide structure, the slotted-array cover plate, and the ground plane of the slotted substrate-integrated-air waveguide (slotted SIAW) antenna array of FIG. 2.
Figure 4B:
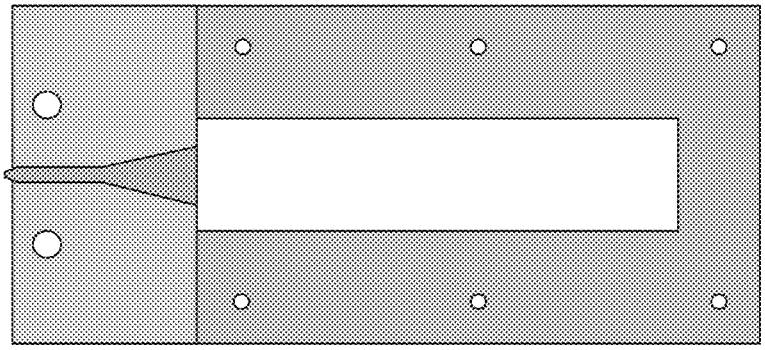
Figure 4C:
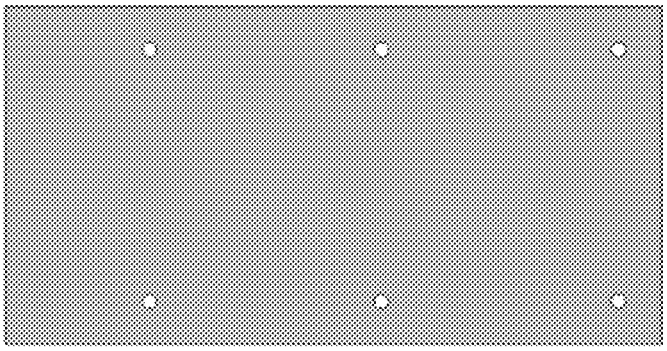

FIG. 3 shows a front/top view of the slotted substrate-integrated-air waveguide antenna array 200 of FIG. 2 (when fully assembly) in accordance with an illustrative embodiment. FIGS. 4A, 4B, and 4C, respectively, show the front/top view of the slotted-waveguide structure 102*a*, the slotted cover plate 104*a*, and the ground plane 106*a* of the slotted substrate-integrated-air waveguide (slotted SIAW) antenna array 200 of FIG. 2.

Figure 5:
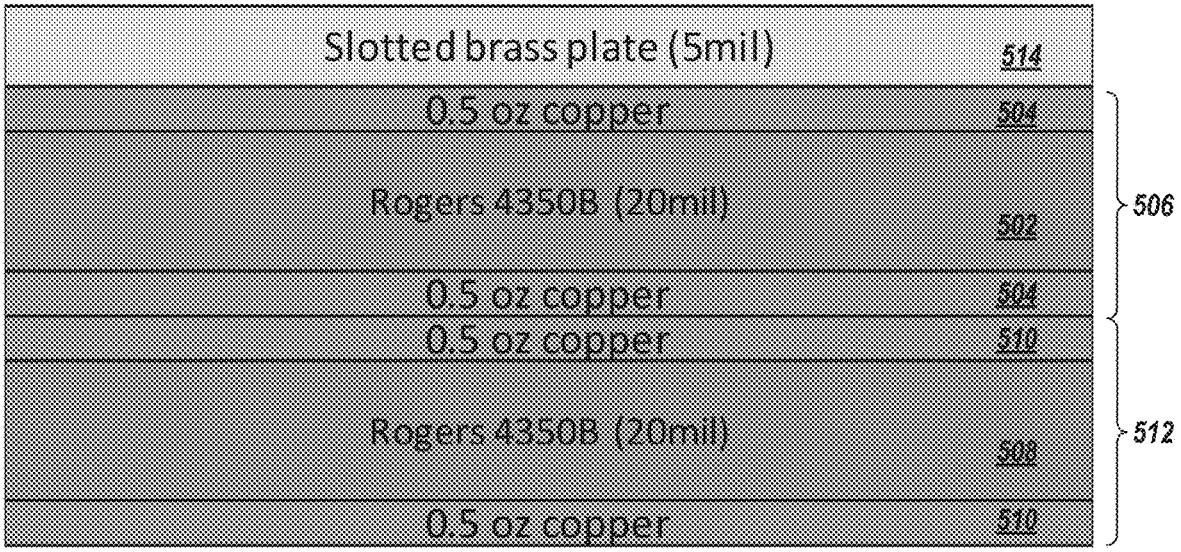
FIG. 5 shows the exemplary slotted substrate-integrated-air waveguide (slotted SIAW) antenna array of FIG. 1 in accordance with an illustrative embodiment.

FIG. 5 shows the exemplary slotted substrate-integrated-air waveguide (slotted SIAW) antenna array 200 in accordance with an illustrative embodiment. In FIG. 5, the air waveguide structure (e.g., 102, 102*a*) is shown comprising a substrate 502 made of a dielectric material (shown as "Rogers 4350B (20 mil)") with a layer 504 of 0.5-oz thickness of copper (collectively shown as 506). The ground plane (e.g., 106, 106*a*) is shown also comprising a substrate 508 made of a dielectric material (shown as "Rogers 4350B (20 mil)") with a layer 510 of 0.5-oz thickness of copper (collectively shown as 512). The slotted cover plate (e.g., 104, 104*a*) is shown comprising a brass plate 514 having a thickness of about 5 mils (0.005 inches±5%).

Figure 6:
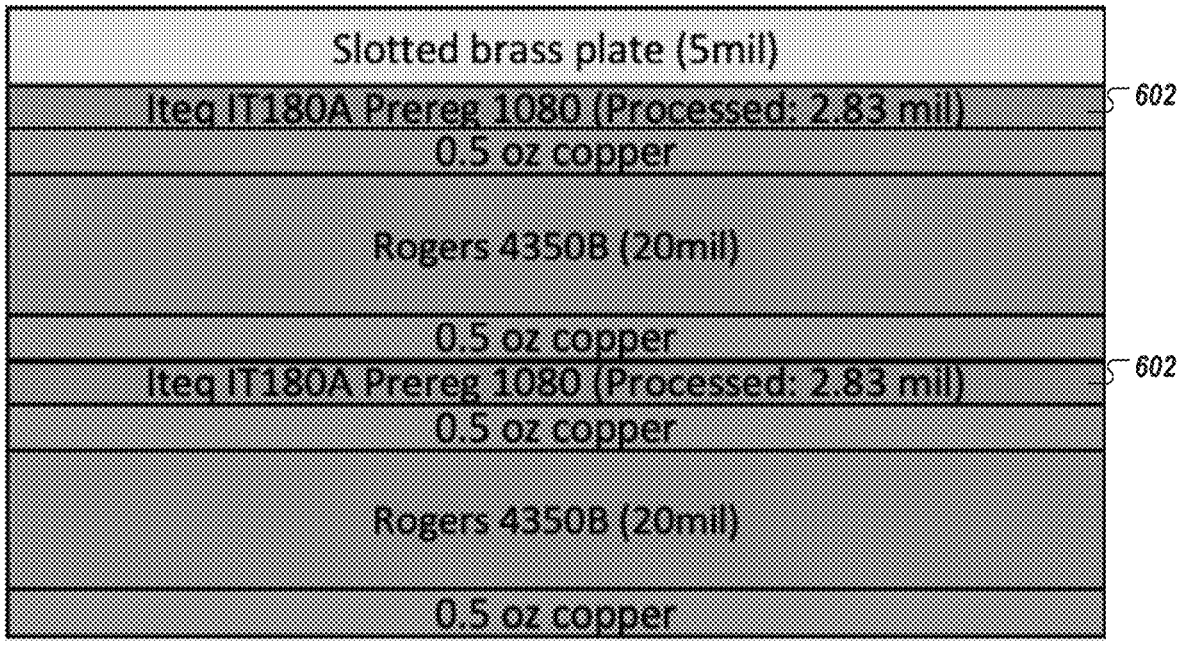
FIG. 6 shows another exemplary slotted substrate-integrated-air waveguide antenna array of FIG. 1 and FIG. 2 in accordance with another illustrative embodiment.

FIG. 6 shows another exemplary slotted substrate-integrated-air waveguide antenna array 100 of FIG. 1 or the slotted substrate-integrated-air waveguide antenna array 200 of FIG. 2 in accordance with another illustrative embodiment. In addition to the structures shown in FIG. 5 (e.g., 502, 504, 508, 510, 514), in FIG. 6, the slotted substrate-integrated-air waveguide antenna array 100 or the slotted substrate-integrated-air waveguide antenna array 200 may include printed-board base material 602 (shown as "Iteq IT180A Prereq 1080" (Processed: 2.83 mil).

Example Method of Fabrication

Figure 9:
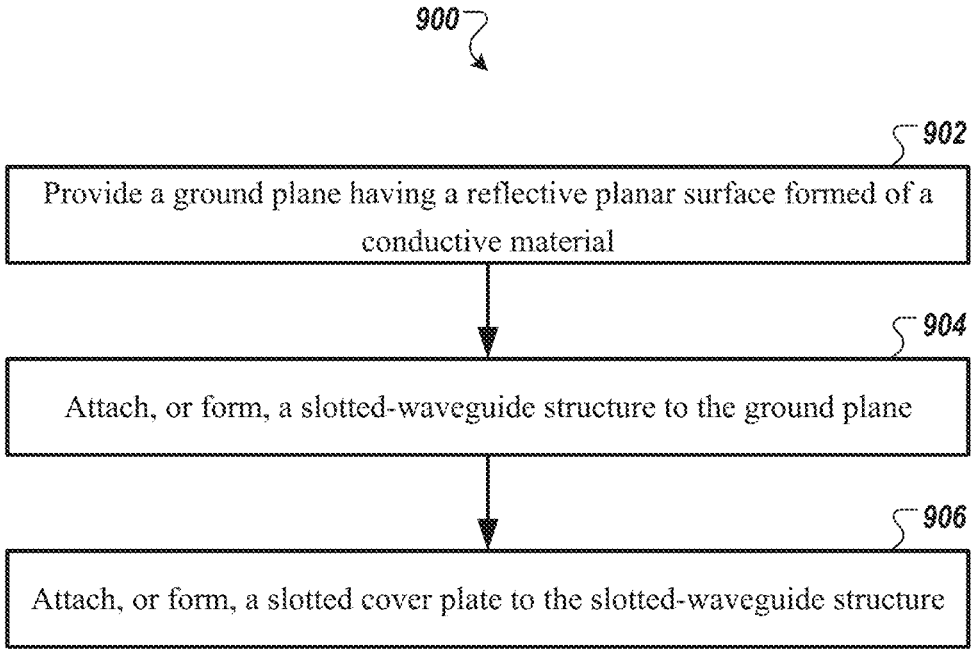
FIG. 9 is a diagram of an exemplary method of fabrication of the exemplary slotted substrate-integrated-waveguide antenna array or the slotted substrate-integrated-air waveguide antenna array in accordance with an illustrative embodiment.

As noted above, the exemplified systems and methods provides a slotted substrate integrated air waveguide (SIAW) antenna array having a design that can be more readily fabricated as compared to comparable performing substrate integrated waveguides. FIG. 9 is a diagram of an exemplary method 900 of fabrication of the exemplary slotted substrate-integrated-air waveguide antenna array 100 or the slotted substrate-integrated-air waveguide antenna array 200 in accordance with an illustrative embodiment. FIGS. 10A, 10B, 10C, and 10D show exemplary intermediate components of the exemplary slotted substrate-integrated-air waveguide antenna array 100 or the slotted substrate-integrated-air waveguide antenna array 200 in accordance with an illustrative embodiment. In some embodiments, the fabrication may be performed entirely using laser cutting, milling and edge plating, though other processing techniques may be used in combination or substitution therewith.

In FIG. 9, the method 900 includes providing 902 a ground plane (e.g., 106, 106*a*) having a reflective planar surface formed of a conductive material. In some embodiments, a suitable RF ground material made of metal or any circuit board substrate material is cut from, say, a continuous metal plate.

Figures 10A, 10B, 10C, 10D:
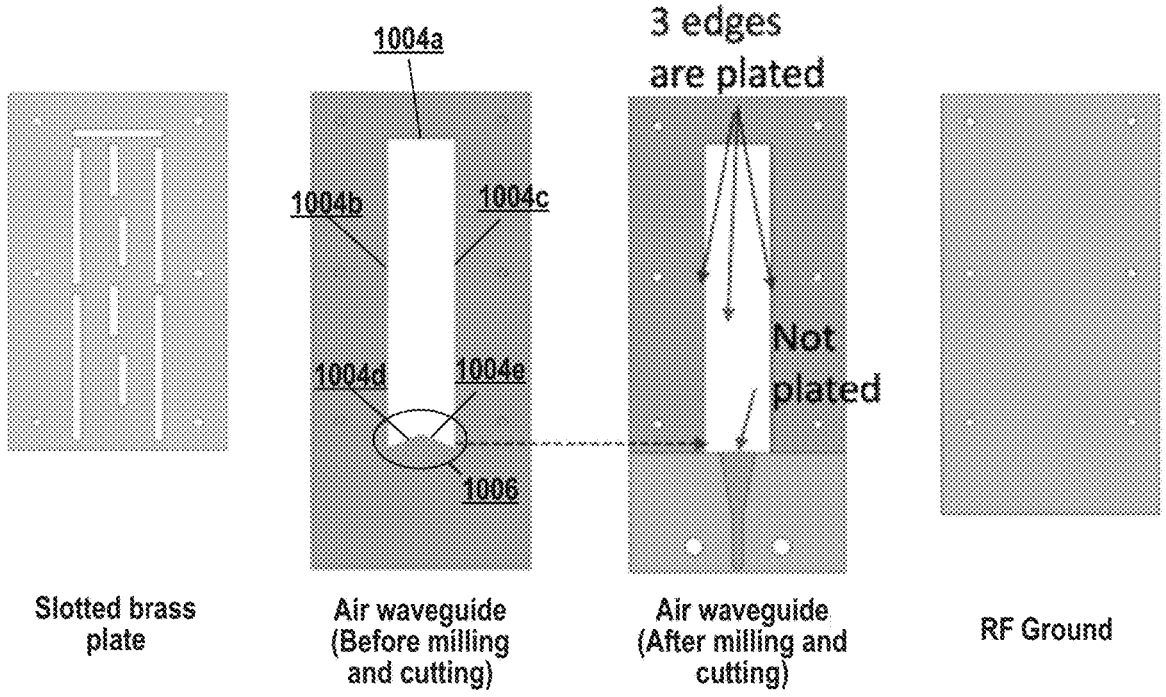
FIGS. 10A, 10B, 10C, and 10D show exemplary intermediate components of the slotted substrate-integrated-air waveguide antenna array in accordance with an illustrative embodiment.

The method 900 further includes attaching (904) a slotted-waveguide structure (e.g., 102, 102*a*) to the ground plane (e.g., 106, 106*a*). In some embodiments, the process of fabricating the slotted-waveguide structure (e.g., 102, 102*a*) for use in step 902 includes forming an aperture 1002 (generally corresponding to the slotted aperture 108, 108*a*) in the waveguide material and then plating the cut structure with a conductive layer. In some embodiments, a polygonal aperture, e.g., with 5 edges is cut into a 20-mil R04350B substrate, for example, as shown in FIG. 10B. The waveguide is then plated with conductive layer, including over the 5 edges (shown as 1004*a*, 1004*b*, 1004*c*, 1004*d*, and 1004*e*). Subsequently, a triangle shape region 1006 in the polygonal shape may be cut from the slotted-waveguide structure (e.g., 102, 102*a*) to form the slotted aperture comprising 4 walls in which 3 are precisely plated of pre-defined thickness and the fourth having non-conductive substrate material (or low conductivity substrate material). Indeed, the polygonal aperture, e.g., with 5 edges, facilitates the coating of the three walls of the slotted aperture 108, 108*a* with a conductive material while also allowing the fourth wall to remain bare, e.g., with the non-conductive substrate material (or low conductivity substrate material). Of course, other geometric shapes may be employed to provide access to the three walls (1004*a*, 1004*b*, 1004*c*) for plating. In some embodiments, the plated substrate may be cut using a laser cutter. Subsequently, the feeding line structure (e.g., 112) may be milled, e.g., via a milling machine, onto the plated slotted-waveguide structure.

The method 900 further includes attaching (906) a slotted cover plate onto the slotted-waveguide structure. In some embodiments, the process of creating the slotted cover plate (e.g., 104, 104*a*) for use in step 904 includes cutting (e.g., laser cutting) radiating slots (antenna array) and alignment holes in a stock plate (e.g., 5-mil brass). Example of the created slotted cover plate is shown in FIG. 10A. The slotted-waveguide structure (e.g., 102, 102*a*) may then be fastened to the slotted cover plate 104 via use of the alignment holes (e.g., 202). Similarly, the ground layer (e.g., 106, 106*b*) may be concurrently fastened to the structure (e.g., of waveguide). In some embodiments, slotted cover plate 104 is soldered to the slotted-waveguide structure through the soldering slots (e.g., 204).

Indeed, the disclosed method provides the selective three-edge-plating of the waveguide (e.g., 102, 102*a*) and the accurate layer-bonding of slotted brass plate and air waveguide.

Figure 11:
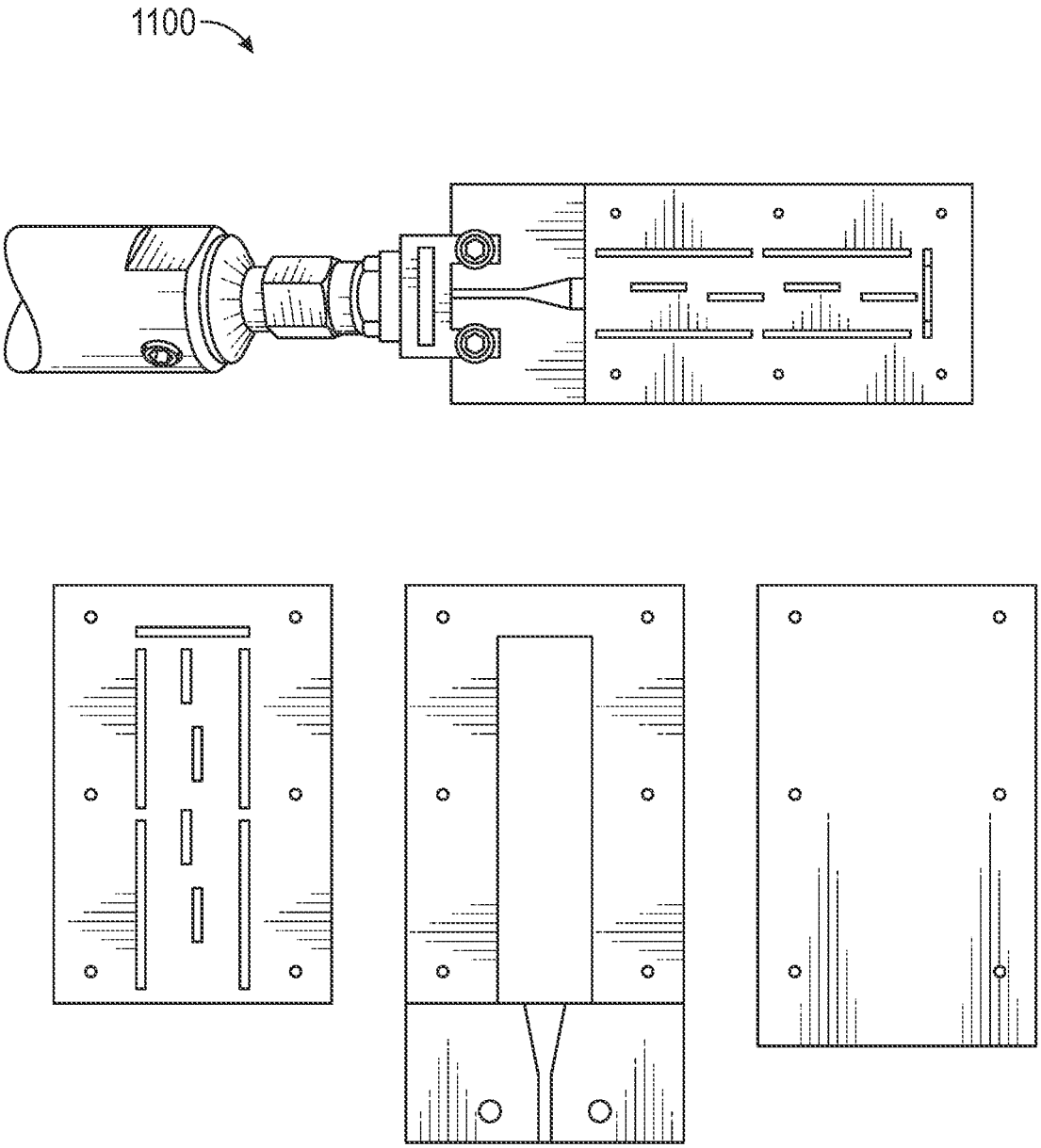
FIG. 11 shows a prototyped slotted substrate-integrated-air waveguide (slotted SIAW) antenna array according to specification discussed in relation to FIGS. 8A-8D in accordance with an illustrative embodiment.

FIG. 11 shows a prototyped slotted substrate-integrated-air waveguide (slotted SIAW) antenna array 200 (shown as 1100) according to specification discussed in relation to FIGS. 8A-8D in accordance with an illustrative embodiment.

Experimental Results

To assess the performance of exemplary slotted substrate-integrated waveguide antenna array and the slotted substrate-integrated-air waveguide antenna array, a study was conducted to simulate and measure performance characteristics of the antenna arrays (e.g., 100, 200). The study also evaluated comparable slotted SIW array for a comparison.

In a simulation, both antenna arrays were configured with the same center frequency. Additional, stimulations were performed for the two antenna arrays when configured with same substrate material (i.e., 20-mil Rogers R04350B). The study evaluated the propagation of the electromagnetic wave from the two antenna arrays.

Figure 12:
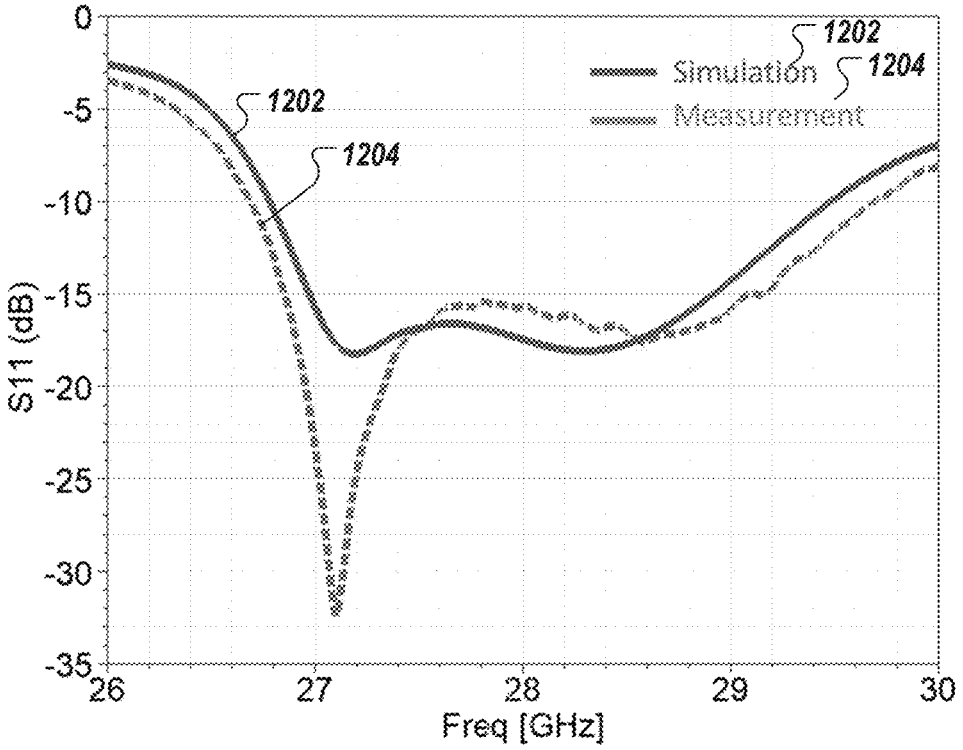
FIG. 12 shows simulated and measured reflection coefficient of the slotted substrate-integrated-air waveguide (slotted SIAW) antenna array of FIG. 11 in millimeter wave operations having frequency ranges centered around 28 GHz in accordance with an illustrative embodiment.
Figure 13:
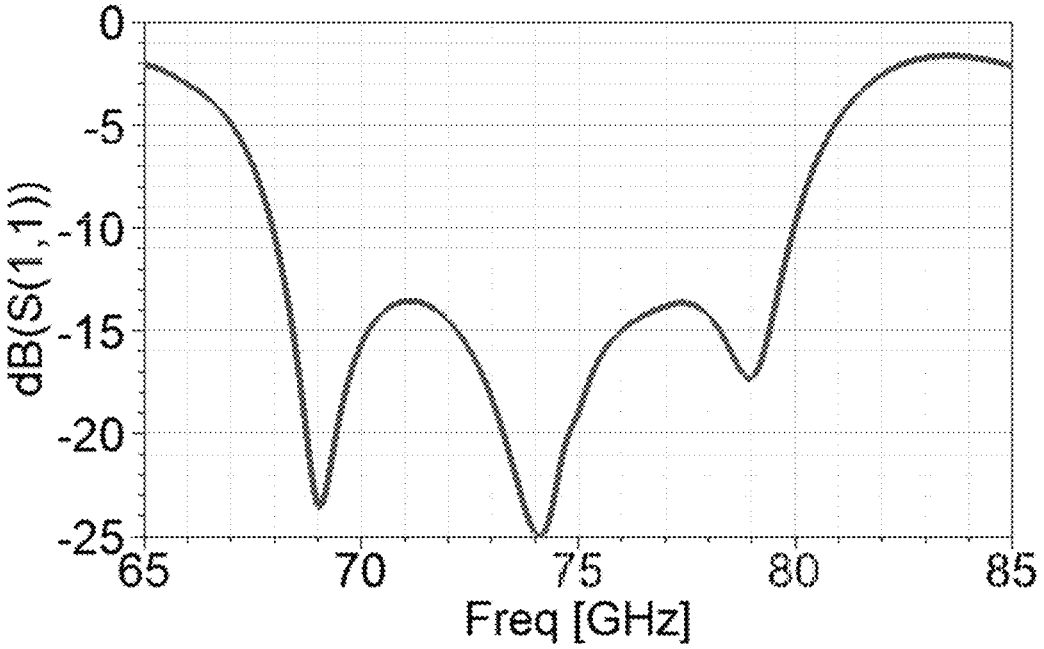
FIG. 13 shows simulated reflection coefficient of the slotted substrate-integrated-air waveguide (slotted SIAW) antenna array of FIG. 11 in higher millimeter wave operations having frequency ranges centered around 77 GHz in accordance with an illustrative embodiment.

FIG. 12 shows simulated (1202) and measured (1204) reflection coefficient (shown as "S11 (dB)") of the slotted substrate-integrated-air waveguide (slotted SIAW) antenna array 200 of FIG. 11 in millimeter wave frequency ranges centered around 28 GHz in accordance with an illustrative embodiment. FIG. 13 shows simulated (1302) reflection coefficient of the slotted substrate-integrated-air waveguide (slotted SIAW) antenna array 200 of FIG. 11 in higher millimeter wave frequency ranges centered around 77 GHz in accordance with an illustrative embodiment. Indeed, the measured and simulation results shows that the slotted substrate-integrated-air waveguide (slotted SIAW) antenna and, thus, the slotted substrate-integrated waveguide (slotted SIAW) antenna are suitable for millimeter wave operation at 28 GHz and 77 GHz, among others.

Figure 14A:
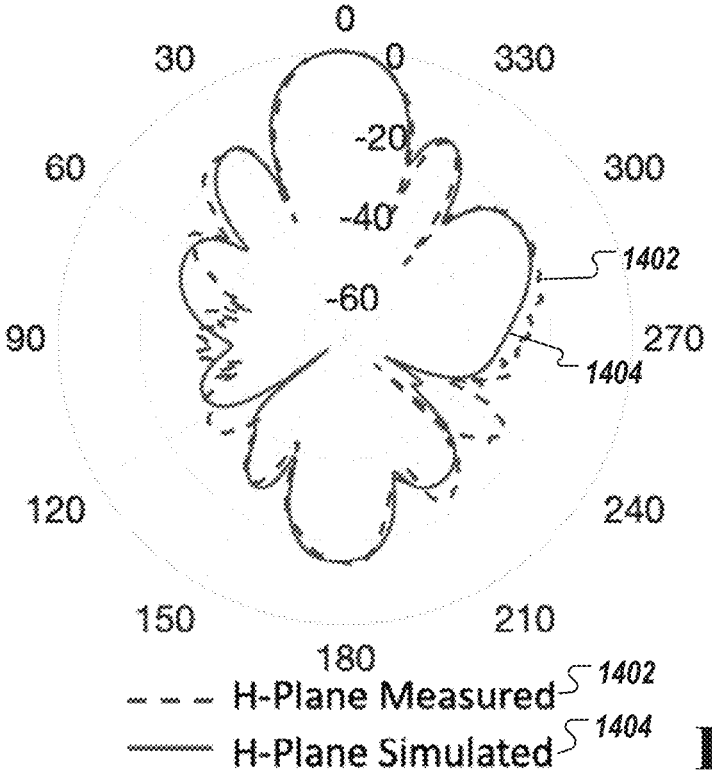
FIGS. 14A and 14B show simulated and measured H-plane and E-plane radiation patterns of the slotted substrate-integrated-air waveguide (slotted SIAW) antenna array of FIG. 11 in millimeter wave operation having frequency ranges centered around 28 GHz in accordance with an illustrative embodiment.
Figure 14B:
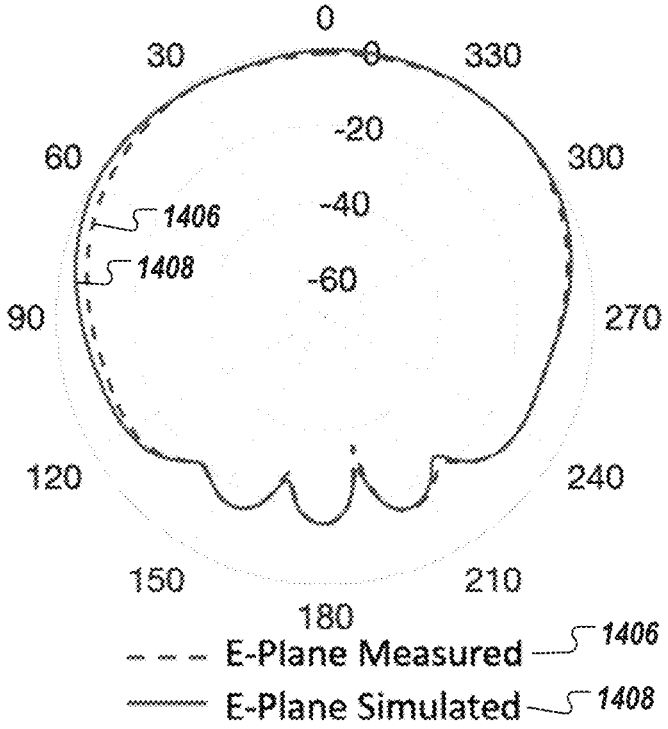

FIGS. 14A and 14B show, respectively, simulated and measured E- and H-plane radiation patterns of the slotted substrate-integrated-air waveguide (slotted SIAW) antenna array 200 of FIG. 11 in millimeter wave operation having a frequency range centered around 28 GHz in accordance with an illustrative embodiment. In FIG. 14A, the H-plane simulated (1402) and measured (1404) results are shown. In FIG. 14B, the E-plane simulated (1406) and measured (1408) results are shown.

Figure 15:
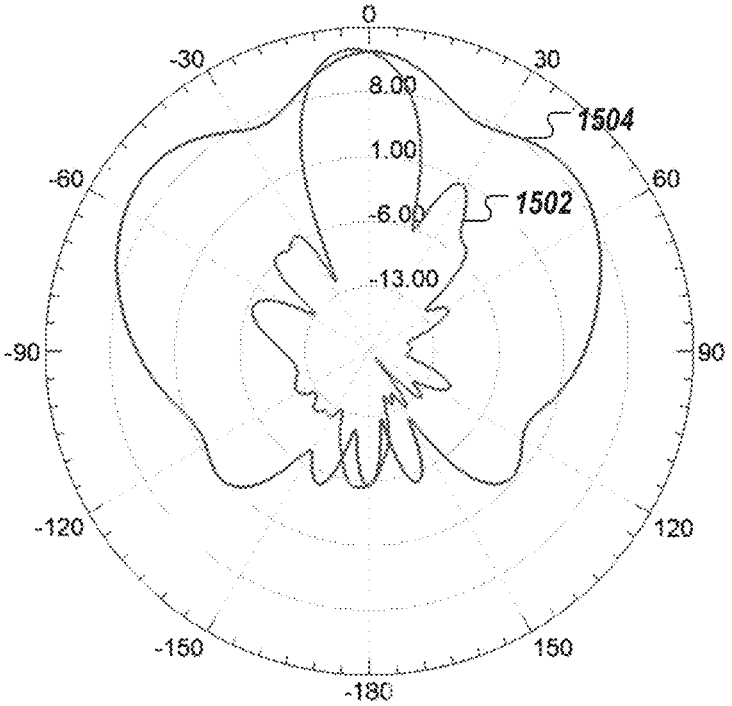
FIG. 15 shows simulated H-plane and E-plane radiation patterns of the slotted substrate-integrated-air waveguide (slotted SIAW) antenna array of FIG. 11 in millimeter wave operation having frequency ranges centered around 77 GHz in accordance with an illustrative embodiment.

FIG. 15 shows simulated H-plane (1502) and E-plane (1504) radiation patterns of the slotted substrate-integrated-air waveguide (slotted SIAW) antenna array 200 of FIG. 11 in millimeter wave frequency ranges centered around 77 GHz in accordance with an illustrative embodiment.

Figure 16:
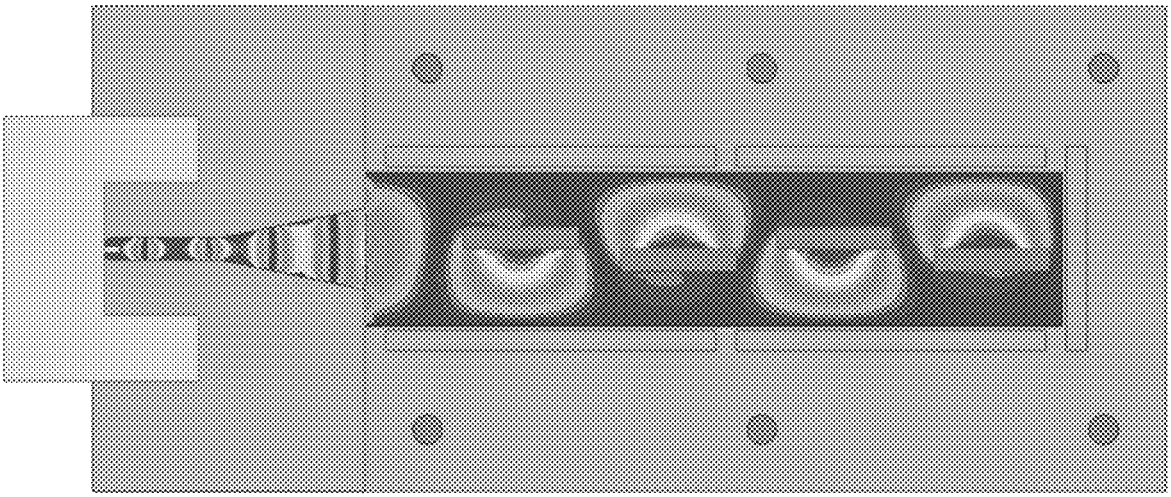
FIG. 16 shows simulated wave leakage performance of the slotted substrate-integrated-air waveguide (slotted SIAW) antenna array of FIG. 11 in accordance with an illustrative embodiment.
Figure 17:
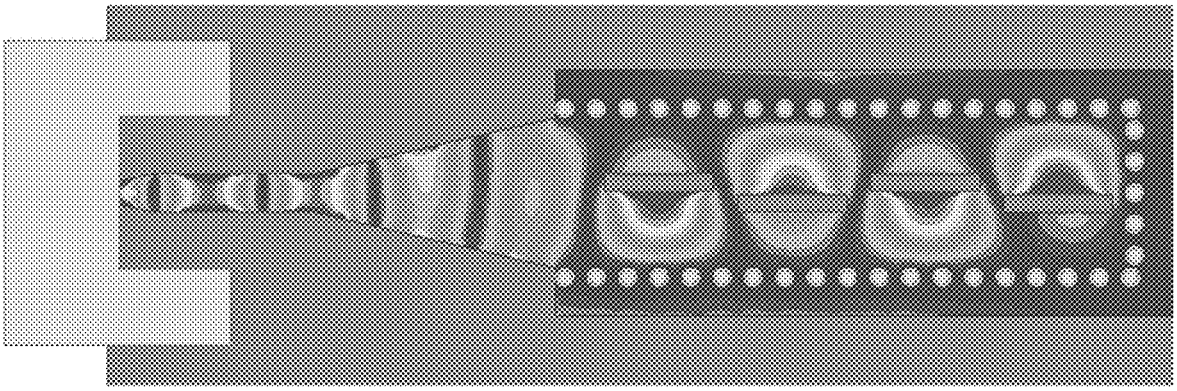
FIG. 17 shows simulated wave leakage performance of a conventional substrate-integrated-waveguide (SIW) antenna array for comparison to the performance of the slotted substrate-integrated-air waveguide (slotted SIAW) antenna array.
Figure 18:
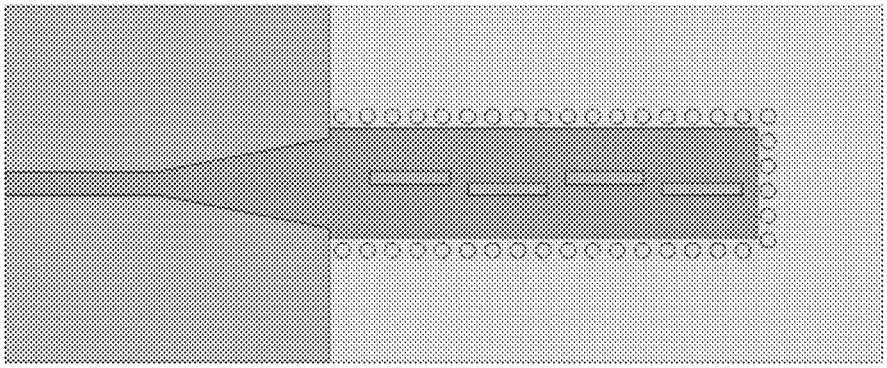
FIG. 18 shows a diagram of a conventional substrate-integrated-waveguide (SIW) antenna array.

FIG. 16 shows simulated wave leakage performance of the slotted substrate-integrated-air waveguide (slotted SIAW) antenna array 200 of FIG. 11 in accordance with an illustrative embodiment. For comparison, FIG. 17 shows simulated wave leakage performance of a conventional substrate-integrated-waveguide (SIW) antenna array. A diagram of the conventional substrate-integrated-waveguide (SIW) antenna array is shown in FIG. 18. Further description of the SIW antenna array can be found in Chen, X. P., Wu, K., Han, L., & He, F., "Low-cost high gain planar antenna array for 60-GHz band applications," IEEE Transactions on Antennas and Propagation, 58(6), 2126-2129 (2010), which is incorporated by reference herein in its entirety.

Figure 19:
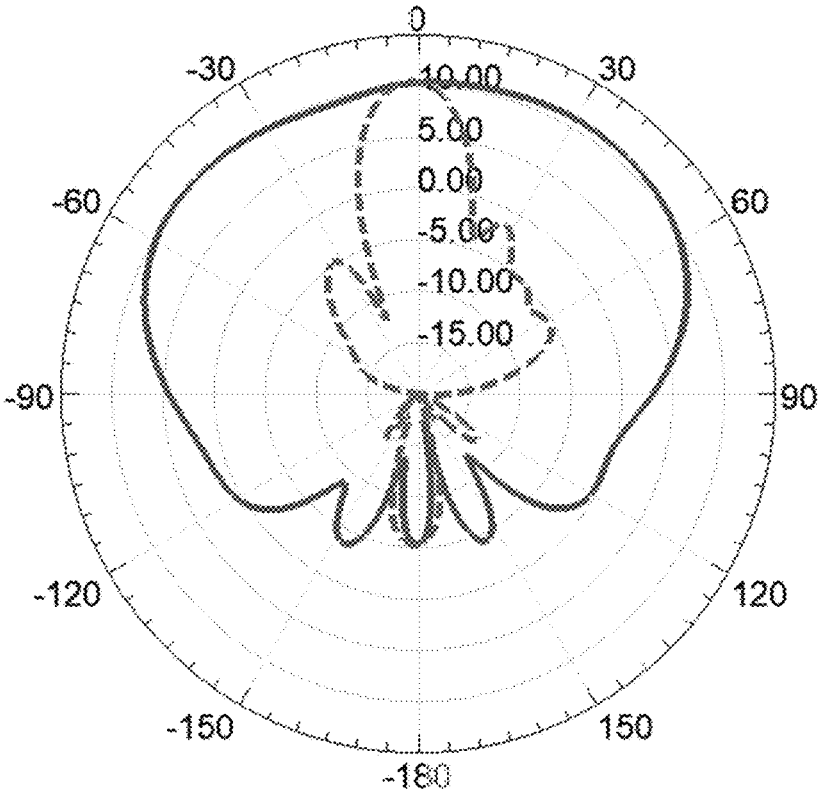
FIGS. 19 and 20 respectively show simulated H-plane and E-plane radiation patterns of the slotted substrate-integrated-air waveguide (slotted SIAW) antenna array 200 of FIG. 11 and of the substrate-integrated-waveguide (SIW) antenna array of FIG. 17.
Figure 20:
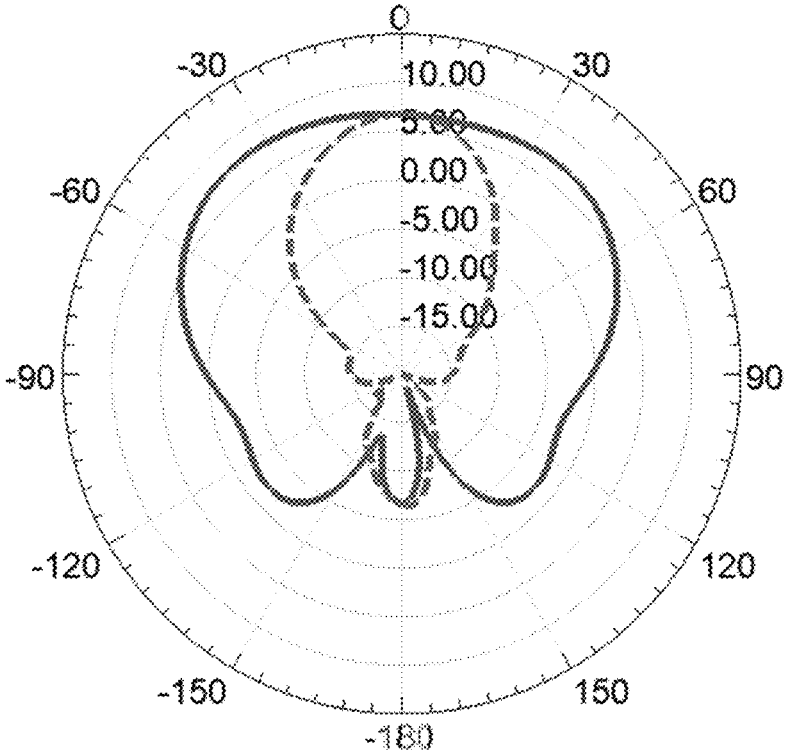

From the study, FIGS. 19 and 20 respectively shows simulated H-plane and E-plane radiation patterns of the slotted substrate-integrated-air waveguide (slotted SIAW) antenna array 200 of FIG. 11 and of the substrate-integrated-waveguide (SIW) antenna array of FIG. 17. The slotted substrate-integrated-air waveguide (slotted SIAW) antenna array 200 was simulated at a center frequency of 28 GHz. The SIW antenna array of FIG. 17 was simulated at a center frequency of 26 GHz. The slotted SIAW antenna array 200 is shown to have a realized gain of about 10.3 dBi and a beamwidth of 20° while the SIW antenna array has a realized gain of 6.8 dBi with a beamwidth of 40°.

Figure 21:
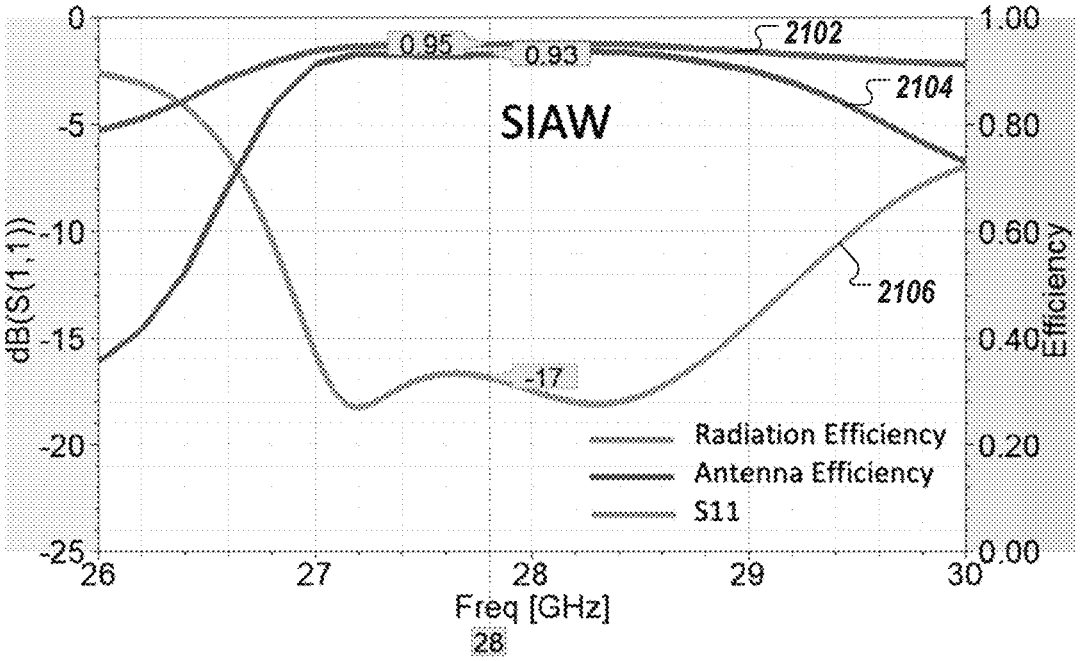
FIGS. 21 and 22 respectively show simulated efficiency performance of the slotted substrate-integrated-air waveguide (slotted SIAW) antenna array of FIG. 11 and the substrate-integrated-waveguide (SIW) antenna array of FIG. 17 in which the same substrate material was used in each of simulation of the antenna arrays.
Figure 22:
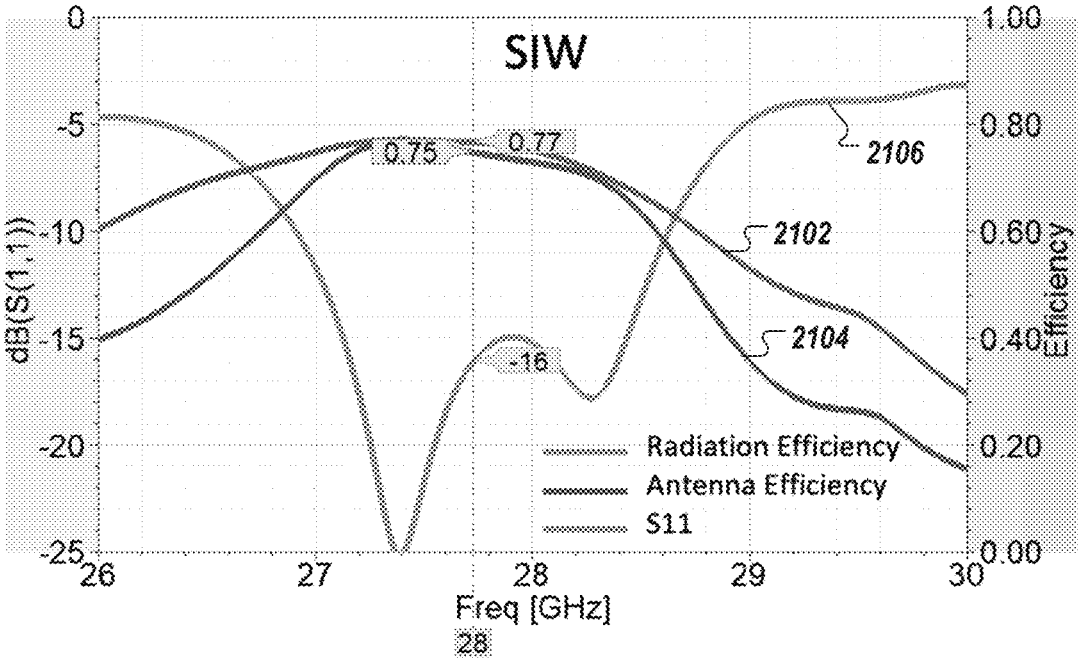
Figure 23:
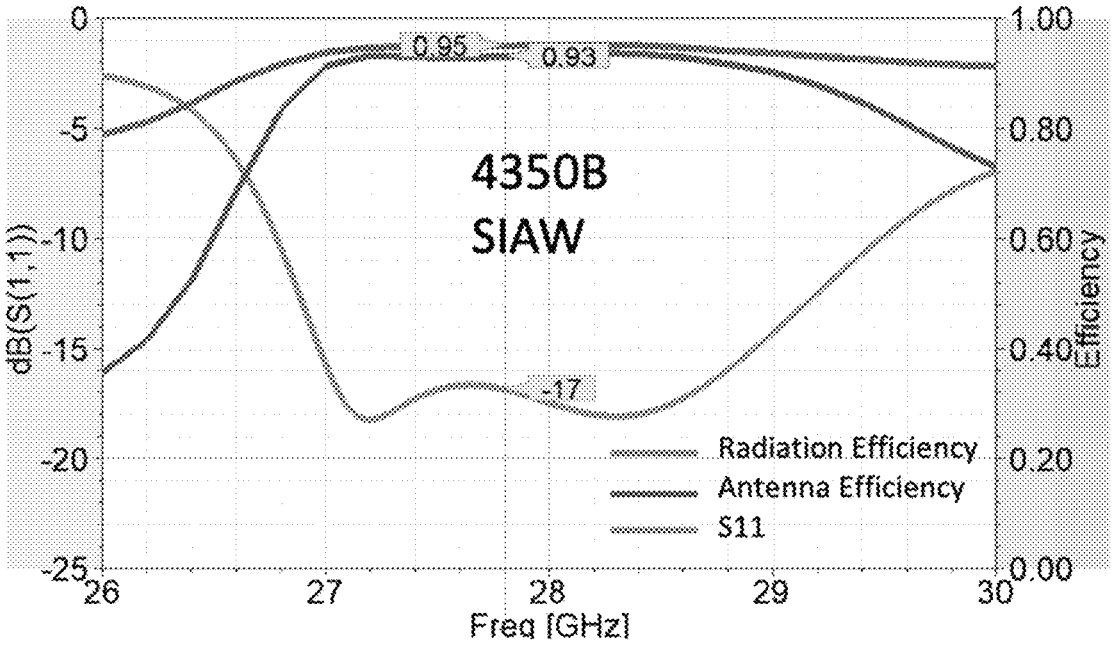
FIGS. 23 and 24 also respectively show simulated efficiency performance of the slotted substrate-integrated-air waveguide (slotted SIAW) antenna array of FIG. 11 and the substrate-integrated-waveguide (SIW) antenna array of FIG. 17 in which lower costing substrate material was used in the slotted substrate-integrated-air waveguide (slotted SIAW) antenna array.
Figure 24:
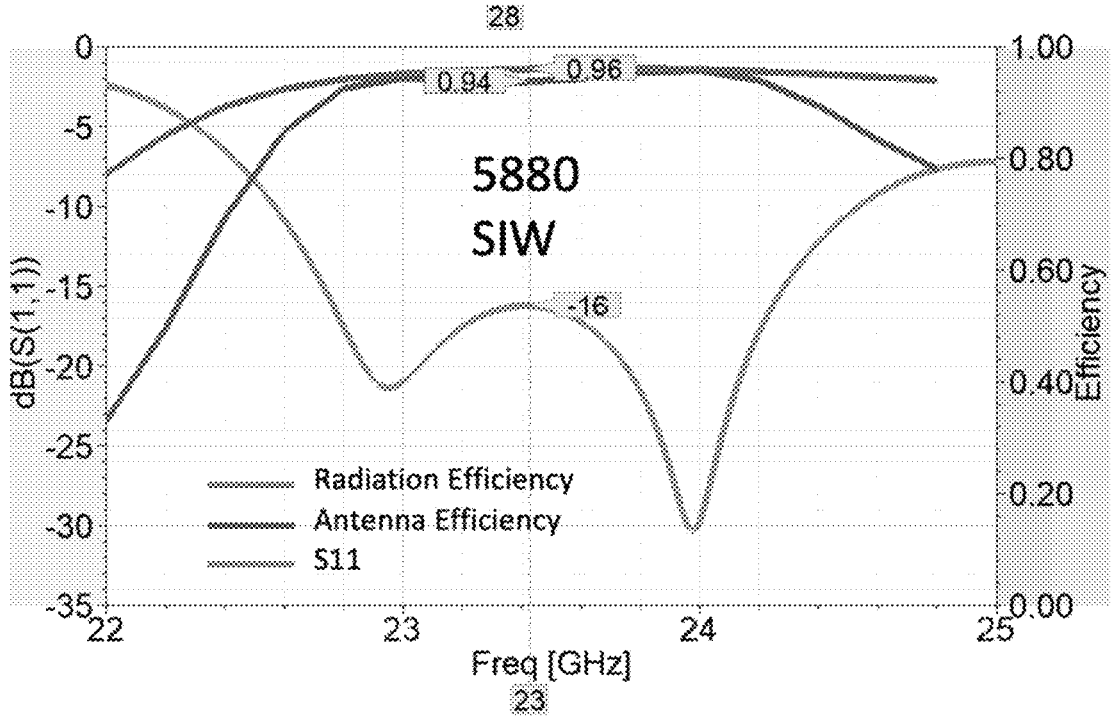

FIGS. 21 and 22 respectively shows simulated efficiency performance of the slotted substrate-integrated-air waveguide (slotted SIAW) antenna array 200 of FIG. 11 and the substrate-integrated-waveguide (SIW) antenna array of FIG. 17, including the radiation efficiency (2002), the antenna efficiency (2004), and the reflection coefficient "S11" (2006). FIGS. 23 and 24 also respectively shows simulated efficiency performance of the slotted substrate-integrated-air waveguide (slotted SIAW) antenna array 200 of FIG. 11 and the substrate-integrated-waveguide (SIW) antenna array of FIG. 17, including the radiation efficiency (2002), the antenna efficiency (2004), and the reflection coefficient "S11" (2006).

In FIGS. 21 and 22, the two antenna arrays used for the simulations were configured with same substrate material (i.e., 20-mil Rogers R04350B). It was observed that the antenna efficiency of the slotted SIAW antenna array 200 is about 20% higher than a comparable SIW array. It was observed that the antenna efficiency of the slotted SIAW antenna array 200 is about 20% higher than a comparable SIW array.

In FIGS. 23 and 24, the slotted substrate-integrated-air waveguide (slotted SIAW) antenna array 200 was configured with 20-mil Rogers R04350B as the substrate material, and substrate-integrated-waveguide (SIW) antenna array was configured with 20-mil Rogers R05880 as the substrate material. It was observed that the slotted substrate-integrated-air waveguide (slotted SIAW) antenna array 200 was configured with 20-mil Rogers R04350B had similar antenna efficiency compared to a substrate-integrated-waveguide (SIW) antenna array configured with 20-mil Rogers R05880. It is noted that the cost of 20-mil Rogers R05880 is about four times higher than 20-mil Rogers R04350B. It is also noted that 20-mil Rogers R04350B provides a rigid structure as compared to 20-mil Rogers R05880. Thus, it was observed that similar antenna performance may be achieved using lower costing substrate material while also having a more rigid antenna structure.

Having thus described several embodiments of the claimed invention, it will be rather apparent to those skilled in the art that the foregoing detailed disclosure is intended to be presented by way of example only, and is not limiting. Many advantages for non-invasive method and system for location of an abnormality in a heart have been discussed herein. Various alterations, improvements, and modifications will occur and are intended to those skilled in the art, though not expressly stated herein. Any alterations, improvements, and modifications are intended to be suggested hereby, and are within the spirit and the scope of the claimed invention. Additionally, the recited order of the processing elements or sequences, or the use of numbers, letters, or other designations therefore, is not intended to limit the claimed processes to any order except as may be specified in the claims. Accordingly, the claimed invention is limited only by the following claims and equivalents thereto.

In some embodiments, the slotted substrate-integrated waveguide (slotted SIW) and slotted substrate-integrated-air waveguide (slotted SIAW) antenna array may be used for millimeter wave antennas, automotive radar antenna arrays, and 5G base station antenna arrays.

What is claimed:

1. A method of fabricating an antenna array, the method comprising:

providing a ground plane having a reflective planar surface formed of a conductive material;

attaching an air-waveguide structure to the ground plane, the air-waveguide structure defined by a waveguide width W and waveguide length L, the air-waveguide structure having a slotted aperture defined, in part, by two conductive side walls that terminate at a conductive end wall, wherein a portion of the two conductive side walls and a portion of the conductive end wall collectively define an aperture-facing radiative conductive surface of the slotted aperture, wherein the slotted aperture has been fabricated by:

i) having a polygonal aperture formed in a stock material, the polygonal aperture comprising five or more edges, wherein three of the five or more edges define the two conductive side walls and the conductive end wall, and wherein a remaining two or more of the five or more edges define an intermediate-shaped region opposite the conductive end wall, ii) plating the five or more edges of the polygonal aperture with a conductive layer, iii) removing the intermediate-shaped region to form a non-conductive end wall that is opposite the conductive end wall, and wherein the aperture-facing radiative conductive surface of the slotted aperture electrically couples with a conductive antenna feedline of the antenna array; and attaching a slotted cover plate onto an exterior surface of the air-waveguide structure, wherein the slotted cover plate has an area that fully covers the slotted aperture, wherein the slotted cover plate has two or more radiating slotted apertures coincident to the slotted aperture of the air-waveguide structure.

2. The method of claim 1, wherein attaching the slotted cover plate onto the exterior surface of air-waveguide structure comprises:

cutting the two or more radiating slotted apertures in a second stock material comprising a plate to form the slotted cover plate; and attaching the slotted cover plate to the exterior surface of air-waveguide structure.

3. The method of claim 2, wherein the slotted cover plate is attached to the air-waveguide structure by a plurality of fasteners, chemical bonding, thermal bonding, laser bonding, welding, soldering, or a combination thereof.

4. The method of claim 3, wherein the slotted cover plate is attached to the air-waveguide structure by:

aligning and connecting the slotted cover plate to the air-waveguide structure using the plurality of fasteners; and soldering a conduction portion of the slotted cover plate to a conduction portion of the air-waveguide structure.

5. The method of claim 1, wherein the slotted cover plate is at least partially formed of copper, aluminum, zinc, nickel, silver, gold, or a combination thereof, and wherein the slotted cover plate has a first electrical conductivity property.

6. The method of claim 5, wherein the conductive layer comprises a material selected from the group consisting of copper, aluminum, zinc, nickel, silver, gold, and a combination thereof, and having a second electrical conductivity property, wherein the second electrical conductivity property is different than the first electrical conductivity property.

7. The method of claim 1, wherein the slotted cover plate comprises a copper zinc alloy.

8. The method of claim 1, wherein the ground plane is formed of a copper, copper alloy, or an alloy formed of one or more of nickel, aluminum, and zinc.

9. The method of claim 1, wherein the two conductive side walls and the conductive end wall form a continuous surface.

10. The method of claim 1, wherein the slotted aperture is generally rectangular.

11. The method of claim 1, wherein the two or more radiating slotted apertures of the slotted cover plate include a number of radiating slotted apertures selected from the group consisting of 2 slots, 3 slots, 4 slots, 5, slots, 6, slots, 7 slots, and 8 slots.

12. The method of claim 1, wherein the antenna array has an antenna efficiency greater than 90 percent.

13. The method of claim 1, wherein the stock material from which the slotted aperture is fabricated is a dielectric material.

14. The method of claim 1, wherein the air-waveguide structure is configured for an operating frequency having a center frequency around 28 GHz or more.

* * * * *